US008044984B2

(12) United States Patent
Hsu et al.

(10) Patent No.: US 8,044,984 B2
(45) Date of Patent: Oct. 25, 2011

(54) METHODS FOR DRIVING AN OLED PANEL

(75) Inventors: Kuo-Tung Hsu, Tainan County (TW); Wei-Jen Chang, Tainan County (TW)

(73) Assignee: Himax Technologies Limited, Sinshih Township, Tainan County (TW)

( * ) Notice: Subject to any disclaimer, the term of this patent is extended or adjusted under 35 U.S.C. 154(b) by 862 days.

(21) Appl. No.: 12/056,392

(22) Filed: Mar. 27, 2008

(65) Prior Publication Data

US 2009/0243499 A1 Oct. 1, 2009

(51) Int. Cl.
*G09G 3/12* (2006.01)

(52) U.S. Cl. ..... 345/691; 345/76; 345/77; 345/78; 345/79; 345/80; 345/81; 345/8; 345/83; 315/169.3

(58) Field of Classification Search ..... 315/169.3; 345/76–83, 691
See application file for complete search history.

(56) References Cited

U.S. PATENT DOCUMENTS 5,943,030 A * 8/1999 Minamibayashi ..... 345/60
6,771,028 B1 * 8/2004 Winters ..... 315/169.1
2006/0164345 A1 * 7/2006 Sarma et al. ..... 345/76
* cited by examiner

*Primary Examiner* — Richard Hjerpe
*Assistant Examiner* — Jeffrey Steinberg
(74) *Attorney, Agent, or Firm* — Thomas|Kayden

(57) ABSTRACT

A method for driving an organic light emitting display (OLED) panel having a plurality of organic light emitting diodes is provided. The organic light emitting diodes are coupled to a plurality of segment lines and a plurality of common lines in a matrix structure. The organic light emitting diodes coupled to the same common lines are divided into a plurality of groups according to colors of the OLED panel. Driving currents are provided to the organic light emitting diodes of the groups according to a plurality of pulse width modulation (PWM) manners. The PWM manners generate waveforms having pulse width corresponding to grayscale in a period, wherein each PWM manner corresponds to different colors of the OLED panel.

23 Claims, 9 Drawing Sheets

METHODS FOR DRIVING AN OLED PANEL

BACKGROUND OF THE INVENTION

1. Field of the Invention

The invention relates to a method for driving an organic light emitting display (OLED) panel, and more particularly to a pulse width modulation (PWM) method for driving an OLED panel.

2. Description of the Related Art

FIG. 1 shows a schematic view of a conventional OLED 100. The OLED 100 comprises a plurality of segment lines 122, a plurality of common lines 132, a plurality of organic light emitting diodes 112, a segment driver 120 and a common driver 130. The organic light emitting diodes 112 are positioned on an OLED panel 110 and are electrically connected to the segment lines 122 and the common lines 132 in a matrix structure. The organic light emitting diodes 112 of one common line 132 are divided into a first group 142 and a second group 144. The segment driver 120 is electrically connected to the segment lines 122 and supplies driving currents to the organic light emitting diodes 112 of the first group 142 and the second group 144 separately according to a first PWM manner and a second PWM manner. The first PWM manner and the second PWM manner have complementary waveforms in a period.

FIG. 2A shows a schematic view of waveforms provided by the first PWM manner of the OLED 100, and FIG. 2B shows a schematic view of waveforms provided by the second PWM manner of the OLED 100. FIG. 2A and FIG. 2B use the waveforms GS1 to GS4 of 2-bit grayscales as an example to show that the first and the second PWM manners have complementary waveforms in a period T. In FIG. 2A, the rising edges of the waveforms GS1 to GS4 corresponding to different grayscales are all positioned at a starting time $t_0$ of the period T. In FIG. 2B, the falling edges of the waveforms GS1 to GS4 corresponding to different grayscales are all positioned at an ending time $t_4$ of the period T.

Referring to FIG. 2A, the rising of the waveforms GS1 to GS4 causes a peak current to be generated at the starting time $t_0$ of the period T. The peak current increases the required Vcc of the segment driver 120 shown in FIG. 1, and the power consumption of the OLED 100 is thus raised. Referring to FIG. 2B, the falling of the waveforms GS1 to GS4 causes the current to be decreased at the ending time $t_4$ of the period T. The current decreases the required Vcc of the segment driver 120 shown in FIG. 1, and the power consumption of the OLED 100 is thus fallen. Therefore, in the OLED 100, the power consumption measured at the starting time $t_0$ and the ending time $t_4$ of the period T is extremely strong when the amount of the organic light emitting diodes 112 of the first group 142 and the second group 144 is increased, wherein the extremely strong power consumption will decrease image quality of the OLED 100.

BRIEF SUMMARY OF THE INVENTION

Methods for driving an OLED panel and an OLED are provided. An exemplary embodiment of such a method for driving an OLED panel, includes an OLED panel having a plurality of organic light emitting diodes, wherein the organic light emitting diodes are coupled to a plurality of segment lines and a plurality of common lines in a matrix structure. The method comprises: dividing the organic light emitting diodes coupled to the same common lines into a plurality of groups according to colors of the OLED panel; and providing driving currents to the organic light emitting diodes of the groups according to a plurality of PWM manners, each corresponding to different colors of the OLED panel, wherein the PWM manners generate waveforms having pulse width corresponding to grayscale in a period. The PWM manners comprise a first PWM manner forming waveforms increased in pulse width by measurement from a starting time of the period; a second PWM manner forming waveforms increased in pulse width by measurement from an ending time of the period; and a third PWM manner forming waveforms increased in pulse width by measurement between the starting time and the ending time of the period.

Furthermore, another exemplary embodiment of a method for driving an OLED panel, includes an OLED panel having a plurality of organic light emitting diodes, wherein the organic light emitting diodes are coupled to a plurality of segment lines and a plurality of common lines in a matrix structure. The method comprises: dividing the organic light emitting diodes coupled to the same common lines into a plurality of groups according to arrangement of the segment lines; dividing the group into a plurality of sub-groups; and providing driving currents to the organic light emitting diodes of the groups according to a plurality of PWM manners, each corresponding to different sub-groups, wherein the PWM manners generate waveforms having pulse width corresponding to grayscale in a period. The PWM manners comprise: a first PWM manner forming waveforms increased in pulse width by measurement from a starting time of the period; a second PWM manner forming waveforms increased in pulse width by measurement from an ending time of the period; and a third PWM manner forming waveforms increased in pulse width by measurement between the starting time and the ending time of the period.

Moreover, an exemplary embodiment of an OLED comprises a plurality of segment lines, a plurality of common lines, a plurality of organic light emitting diodes and a segment driver coupled to the segment lines. The organic light emitting diodes are electrically connected to the segment lines and the common lines in a matrix structure, wherein the organic light emitting diodes of one common line are divided into a plurality of groups according to colors of the OLED panel. The segment driver provides driving currents to the organic light emitting diodes of the groups according to a plurality of PWM manners, each corresponding to different colors of the OLED panel, wherein the PWM manners generate waveforms having pulse width corresponding to grayscale in a period, and the waveforms representing the same grayscale of the PWM manners rise at different time points in the period except for a highest grayscale.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
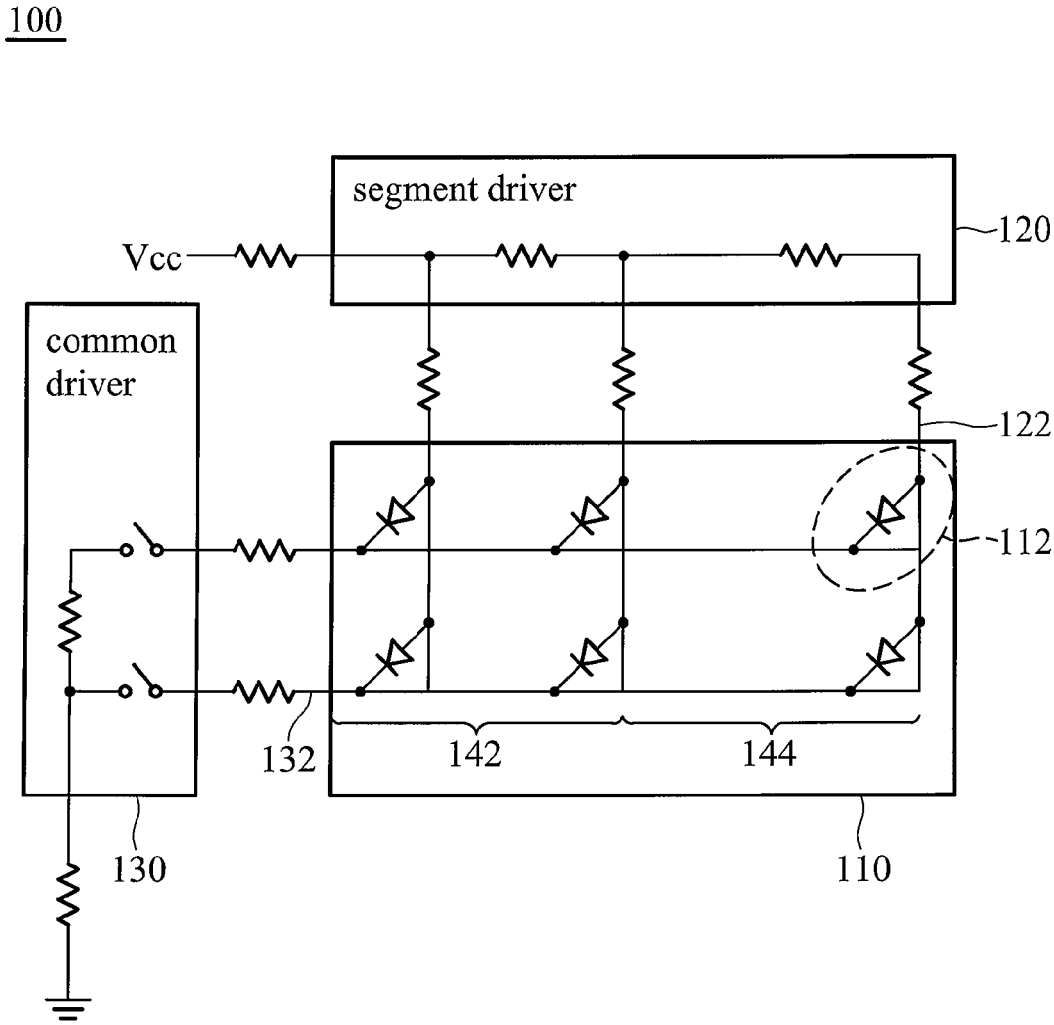
FIG. 1 shows a schematic view of a conventional OLED.
Figure 2A:
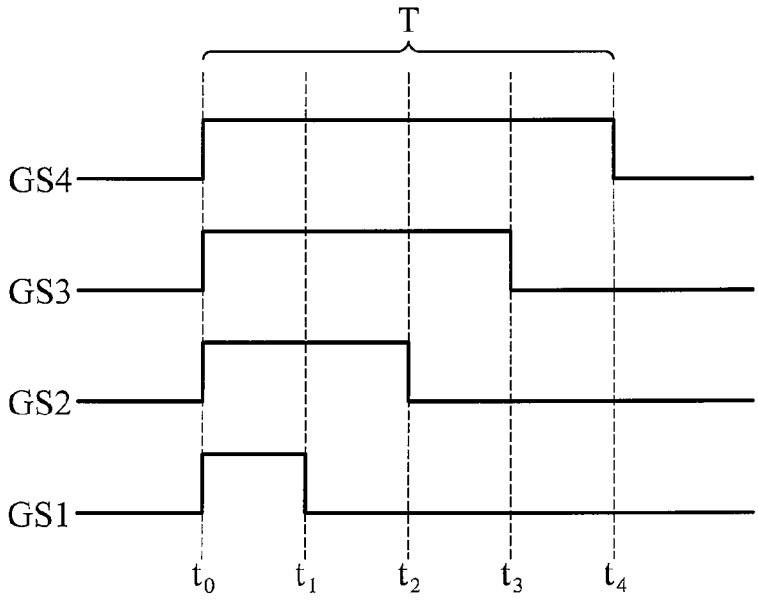
FIG. 2A shows a schematic view of waveforms provided by the first PWM manner of the conventional OLED.
Figure 2B:
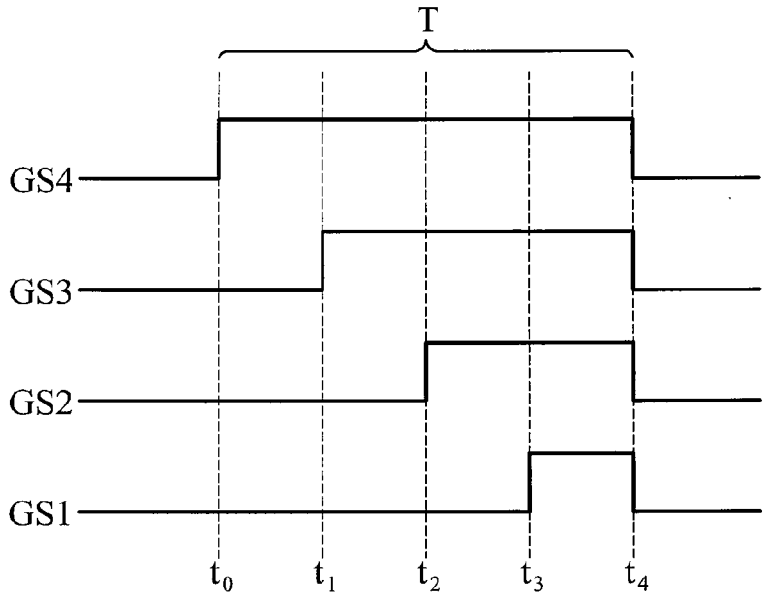
FIG. 2B shows a schematic view of waveforms provided by the second PWM manner of the conventional OLED.
Figure 3:
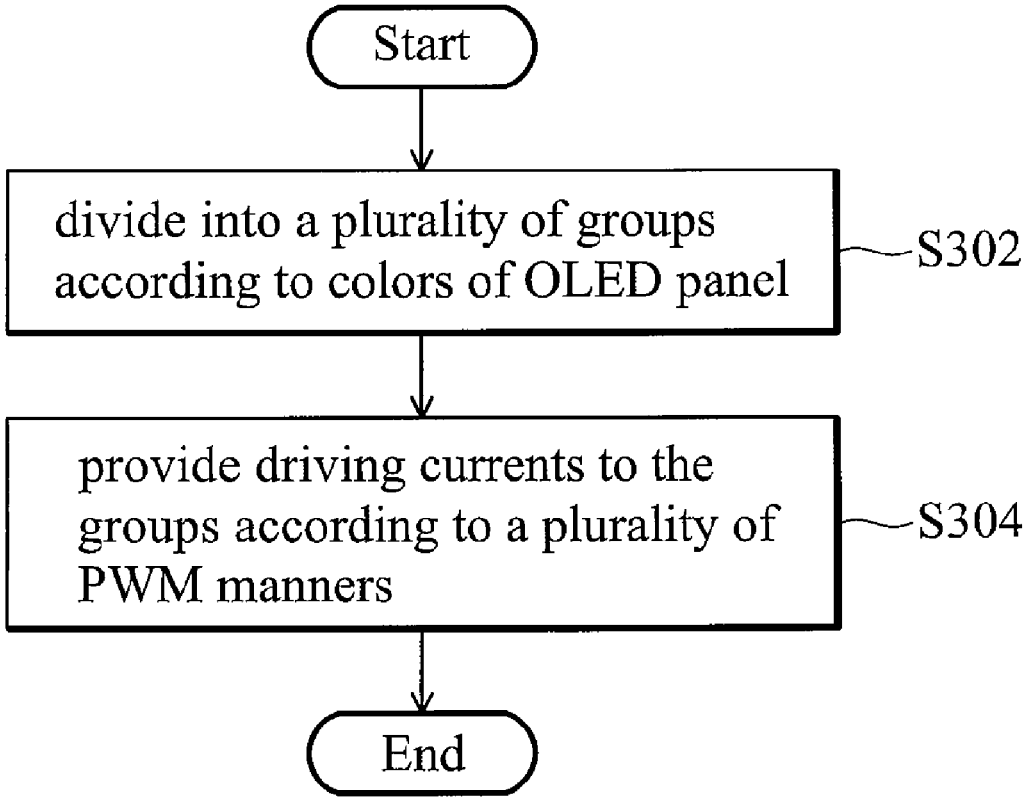
FIG. 3 shows a method for driving an OLED panel according to an embodiment of the invention.

FIG. 3 shows a method for driving an OLED panel according to an embodiment of the invention. The OLED panel has a plurality of organic light emitting diodes, and the organic light emitting diodes are coupled to a plurality of segment lines and a plurality of common lines in a matrix structure. First, in step S302, the organic light emitting diodes coupled to the same common lines are divided into a plurality of groups according to colors of the OLED panel. For example, the OLED panel is a panel with three primary colors (red, green and blue), wherein a first group corresponds to red color of the OLED panel, a second group corresponds to green color and a third group corresponds to blue color. Next, in step S304, the OLED panel provides driving currents to the organic light emitting diodes of the groups according to a plurality of PWM manners respectively, wherein the PWM manners generate waveforms having pulse width corresponding to grayscale in a period and each PWM manner corresponds to different colors of the OLED panel. For example, a first PWM manner corresponds to red color and is applied to the first group, a second PWM manner corresponds to green color and is applied to the second group, and a third PWM manner corresponds to blue color and is applied to the third group.

Figure 4:
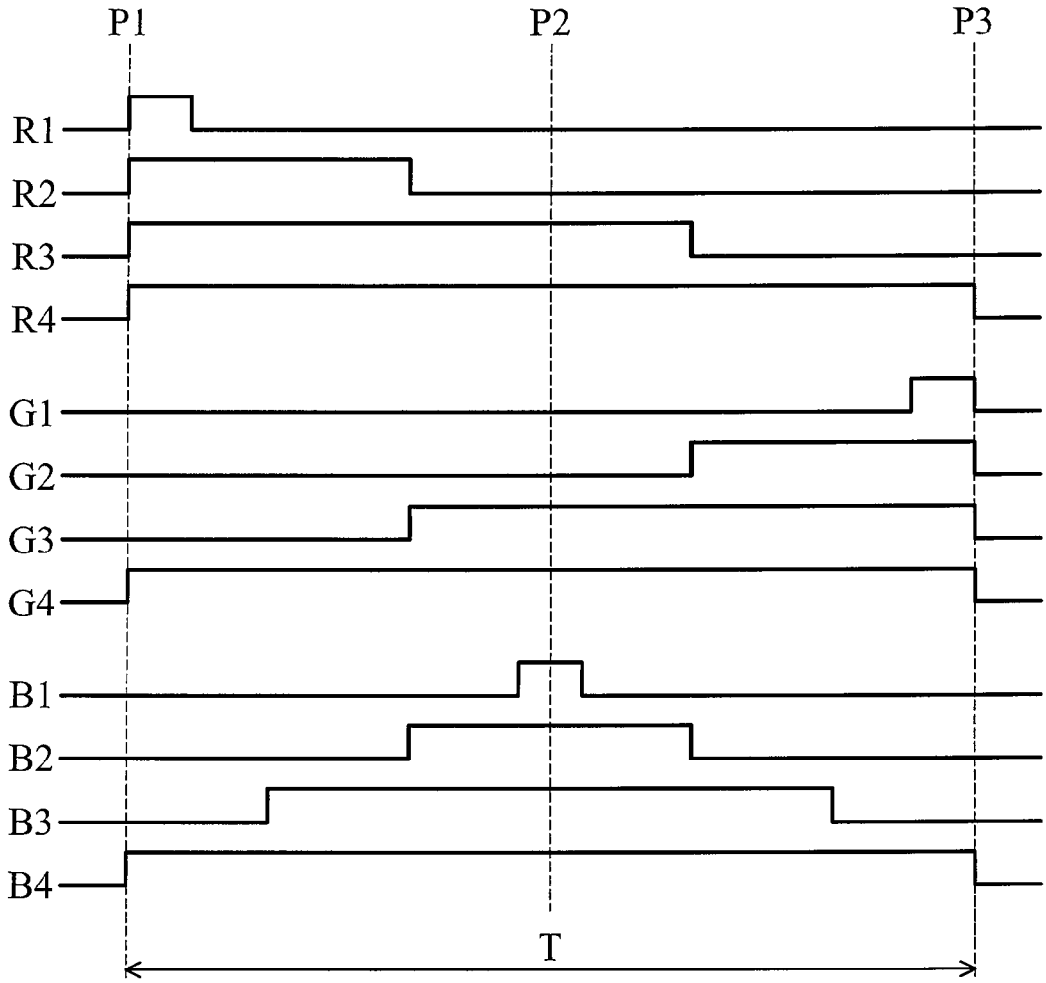
FIG. 4 shows waveforms of the segment lines provided by a method for driving an OLED panel with three primary colors according to an embodiment of the invention.

FIG. 4 shows waveforms of the segment lines provided by a method for driving an OLED panel with three primary colors according to an embodiment of the invention. In FIG. 4, twelve segment lines R1-R4, G1-G4 and B1-B4 are coupled to the same common line. The segment lines R1-R4 are coupled to the organic light emitting diodes corresponding to red color (e.g. the first group), wherein the first PWM manner is applied to the segment lines R1-R4. The segment lines G1-G4 are coupled to the organic light emitting diodes corresponding to green color (e.g. the second group), wherein the second PWM manner is applied to the segment lines G1-G4. The segment lines B1-B4 are coupled to the organic light emitting diodes corresponding to blue color (e.g. the third group), wherein the third PWM manner is applied to the segment lines B1-B4.

The waveforms of the segment lines R1-R4 represent different grayscales (such as from a lowest grayscale to a highest grayscale) respectively, and the rising edges of the waveforms of the segment lines R1-R4 are all positioned at a starting point P1 of a period T. The period T is a refresh period of the OLED panel. The waveforms of the segment lines G1-G4 are represented by different grayscales respectively, and the falling edges of the waveforms of the segment lines G1-G4 are all positioned at an ending point P3 of the period T. The waveforms of the segment lines B1-B4 are represented by different grayscales respectively, and the centers of the waveforms of the segment lines B1-B4 are all positioned at a center point P2 of the period T. In this embodiment, each manner corresponds to different colors of the OLED panel. Therefore, variation of image quality is not obvious to observe by a user due to the fact that peak current is generated and affected at the same color.

As shown in FIG. 4, the waveforms of the first group provide by the first PWM manner are increased in pulse width by measurement from the starting point P1 (i.e. a starting time of the period T). The waveforms of the second group provide by the second PWM manner are increased in pulse width by measurement from the ending point P3 (i.e. an ending time of the period T). The waveforms of the third group provide by the third PWM manner are increased in pulse width by measurement from the center point P2 (i.e. a center time of the period T) and extending toward both the starting point P1 and the ending point P3. Except for the highest grayscale (e.g. the waveforms of the segment lines R4, G4 and B4), the waveforms representing the same grayscale of the first, second and third PWM manners rise and fall at different time points in the period T. Furthermore, except for the highest grayscale, the rising time points of the waveforms corresponding to the second and third PWM manners are separately different with the first manner, and the falling time points of the waveforms corresponding to the first and third PWM manners are different with the second manner. In one embodiment, an up/down counter is used and the waveforms provided by the third PWM manner can be symmetric to the center point P2.

Figure 5:
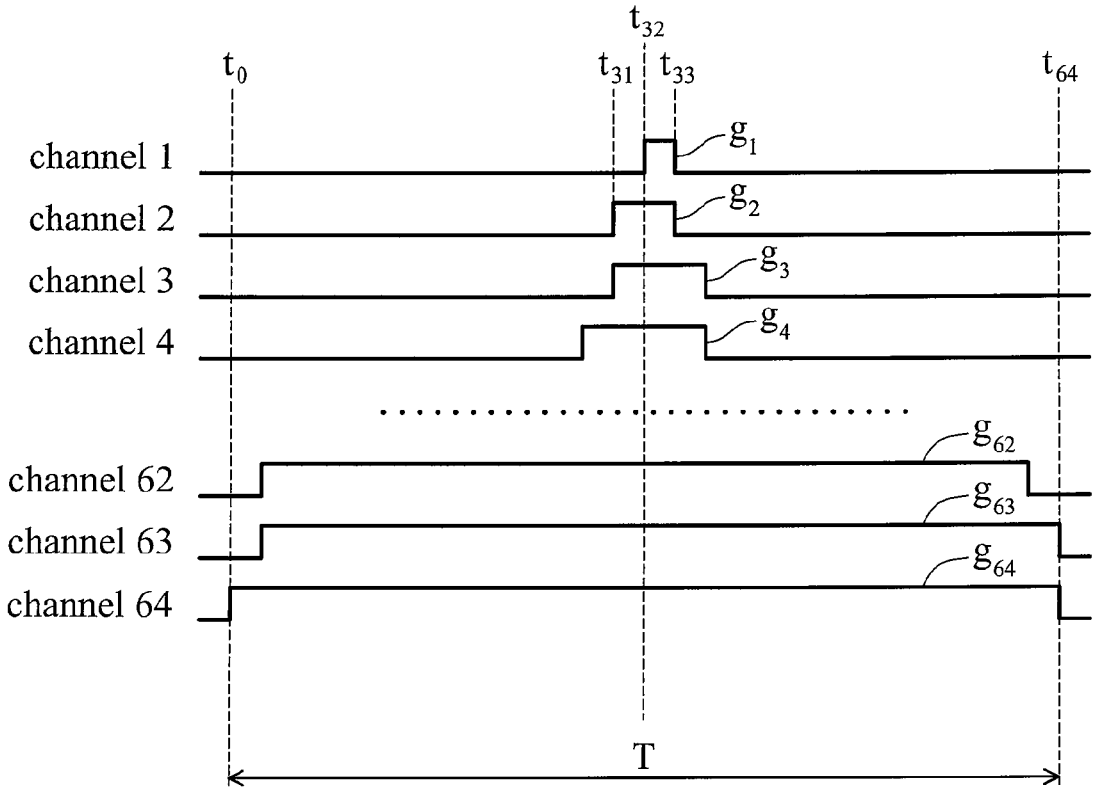
FIG. 5 shows waveforms of the segment lines provided by another third PWM manner according to an embodiment of the invention.

FIG. 5 shows waveforms of the segment lines provided by another third PWM manner according to an embodiment of the invention, wherein the third PWM manner forms waveforms increased in pulse width by measurement between a starting time $t_0$ and an ending time $t_{64}$ of the period T. In FIG. 5, the waveforms of channels 1-64 are separately indicated grayscales 1-64. In channel 1, a waveform of grayscale 1 is shown. A pulse g1 is located between a center time $t_{32}$ and time $t_{33}$. In channel 2, a pulse g2 shown of grayscale 2 is located between time $t_{31}$ and the time $t_{33}$. As shown in FIG. 5, the waveform of grayscale N (N is odd) is provided by increasing a scale from a right side of the waveform of grayscale (N−1), and the waveform of grayscale N (N is even) is provided by increasing a scale from a left side of the waveform of grayscale (N−1). In one embodiment, the waveform of grayscale N (N is odd) is provided by increasing a scale from a left side of the waveform of grayscale (N−1), and the waveform of grayscale N (N is even) is provided by increasing a scale from a right side of the waveform of grayscale (N−1).

Figure 6:
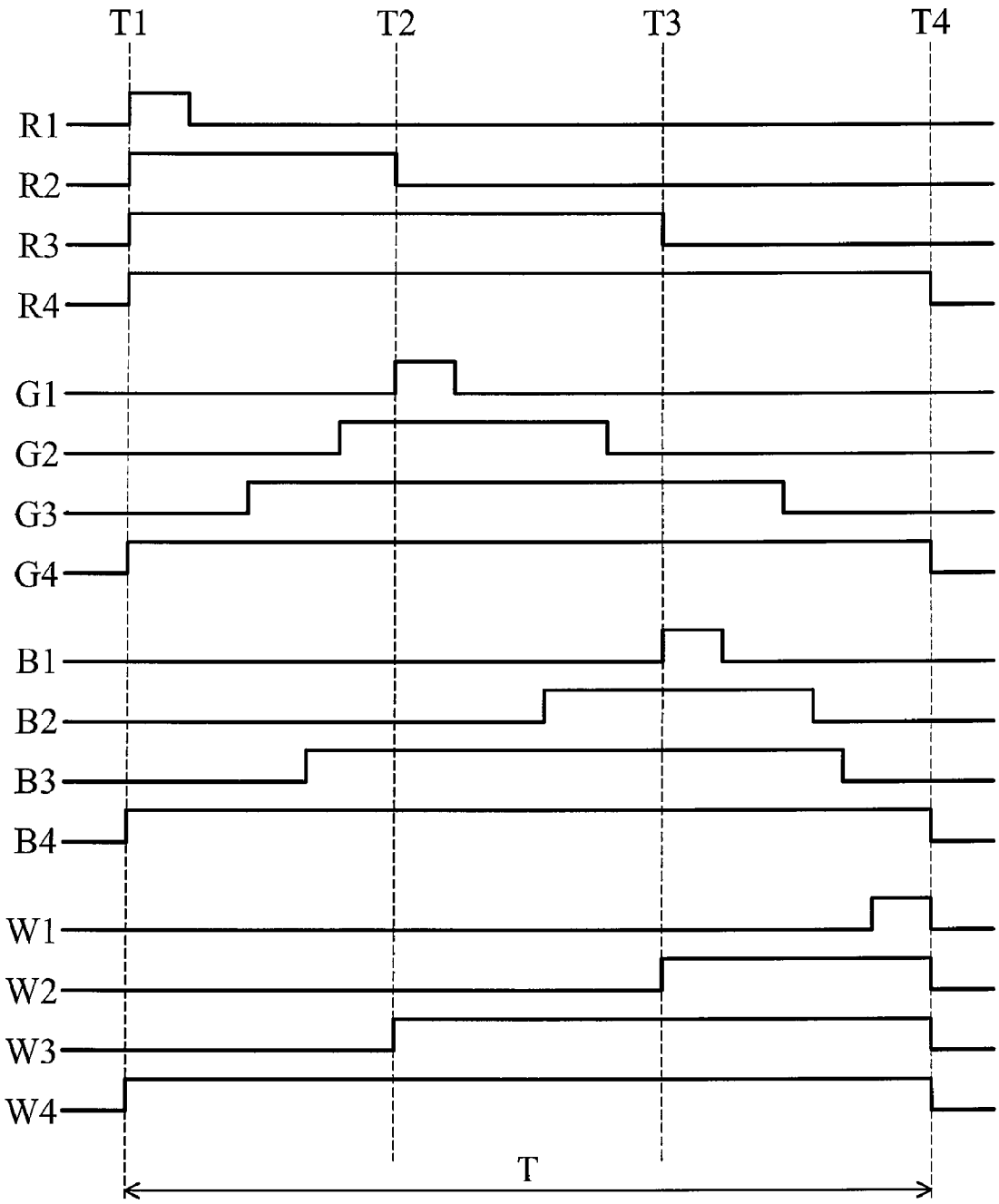
FIG. 6 shows waveforms of the segment lines provided by a method for driving an OLED panel with red, green, blue and white colors according to an embodiment of the invention.

FIG. 6 shows waveforms of the segment lines provided by a method for driving an OLED panel with red, green, blue and white colors according to an embodiment of the invention. Sixteen segment lines R1-R4, G1-G4, B1-B4 and W1-W4 are coupled to the same common line. The segment lines R1-R4 are coupled to the organic light emitting diodes corresponding to red color (e.g. a first group), wherein a first PWM manner is applied to the segment lines R1-R4. The segment lines G1-G4 are coupled to the organic light emitting diodes corresponding to green color (e.g. a second group), wherein a second PWM manner is applied to the segment lines G1-G4. The segment lines B1-B4 are coupled to the organic light emitting diodes corresponding to blue color (e.g. a third group), wherein a third PWM manner is applied to the segment lines B1-B4. The segment lines W1-W4 are coupled to the organic light emitting diodes corresponding to white color (e.g. a fourth group) and a fourth PWM manner is applied to the segment lines W1-W4.

As shown in FIG. 6, the waveforms of the first group provide by the first PWM manner are increased in pulse width by measurement from a starting time T1 of the period T. The waveforms of the second group provide by the second PWM manner are increased in pulse width by measurement from a time T2 of the period T and extending toward both sides. The waveforms of the third group provide by the third PWM manner are increased in pulse width by measurement from a time T3 of the period T and extending toward both sides. The waveforms of the fourth group provide by the fourth PWM manner are increased in pulse width by measurement from an ending time T4 of the period T. The time T2 is between the starting time T1 and the time T3, and the time T3 is between the time T2 and the ending time T4.

Figure 7:
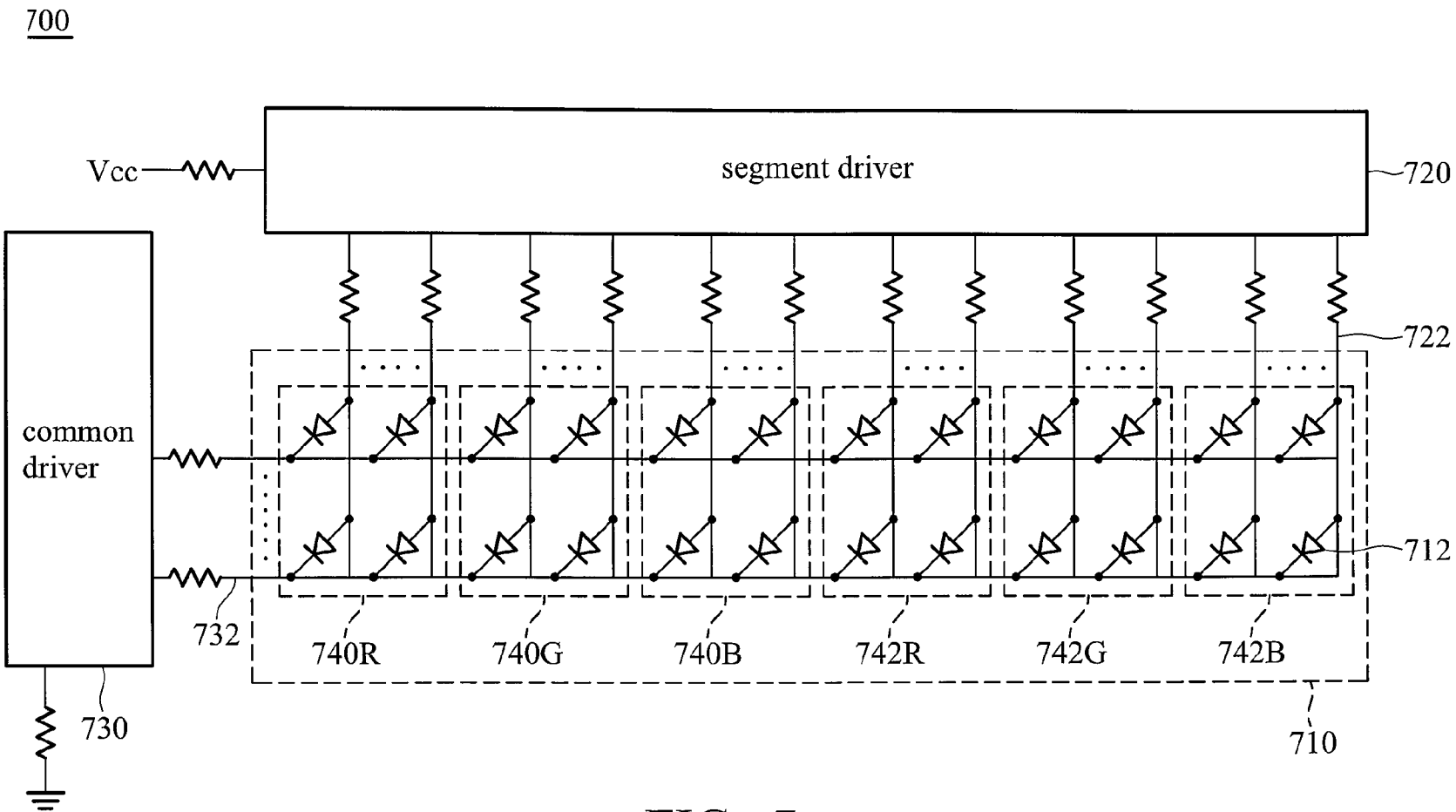
FIG. 7 shows a schematic view of an OLED 700 according to an embodiment of the invention.

FIG. 7 shows a schematic view of an OLED 700 according to an embodiment of the invention. The OLED 700 comprises a plurality of segment lines 722, a plurality of common lines 732, a plurality of organic light emitting diodes 712, a segment driver 720 and a common driver 730. The organic light emitting diodes 712 are positioned on an OLED panel 710 with three primary colors and are electrically connected to the segment lines 722 and the common lines 732 in a matrix structure. The organic light emitting diodes 712 of one common line 732 are divided into the blocks 740R-740B and 742R-742B. The segment driver 720 is electrically connected to the segment lines 722 and supplies driving currents to the organic light emitting diodes 712 of the blocks 740R-740B and 742R-742B according to a first PWM manner, a second PWM manner and a third PWM manner. A first group corresponds to red color of the OLED panel 710 and comprises the blocks 740R and 742R. A second group corresponds to green color of the OLED panel 710 and comprises the blocks 740G and 742G. A third group corresponds to blue color of the OLED panel 710 and comprises the blocks 740B and 742B. Furthermore, the first PWM manner illustrated in FIG. 4 can apply to the first group; the second PWM manner illustrated in FIG. 4 can apply to the second group; and the third PWM manner illustrated in FIG. 4 can apply to the third group.

Figure 8A:
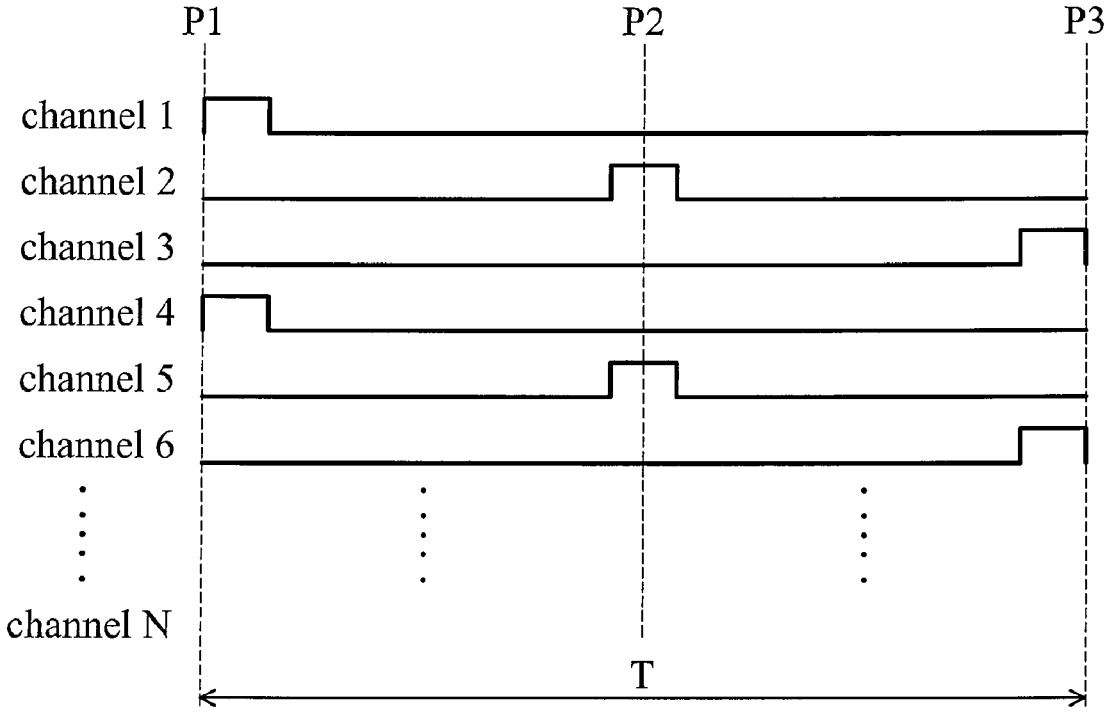
FIG. 8A shows waveforms of the segment lines provided by a method for driving an OLED panel according to an embodiment of the invention.

FIG. 8A shows waveforms of the segment lines provided by a method for driving an OLED panel according to an embodiment of the invention. In FIG. 8A, channel sequence corresponds to arrangement of the segment lines, and each channel is coupled to different organic light emitting diodes, which correspond to the same color and is coupled to the same common line. Channel 1 to channel N are divided into a plurality of groups according to channel sequence, and each group is also divided into three sub-groups according to channel sequence, wherein each sub-group corresponds to one channel. As shown in FIG. 8A, a first group comprises the channels 1-3, and a second group comprises the channels 4-6 and so on. Furthermore, in the first group, the channels 1-3 are separately divided into a first sub-group, a second sub-group and a third sub-group. In the second group, the channels 4-6 are also separately divided into the first, second and third sub-groups. In other words, the first sub-group comprises the channels 1 and 4, the second sub-group comprises the channels 2 and 5, and the third sub-group comprises the channels 3 and 6. In this embodiment, the first PWM manner illustrated in FIG. 4 is applied to the first sub-group; the third PWM manner illustrated in FIG. 4 is applied to the second sub-group; and the second PWM manner illustrated in FIG. 4 is applied to the third sub-group.

Figure 8B:
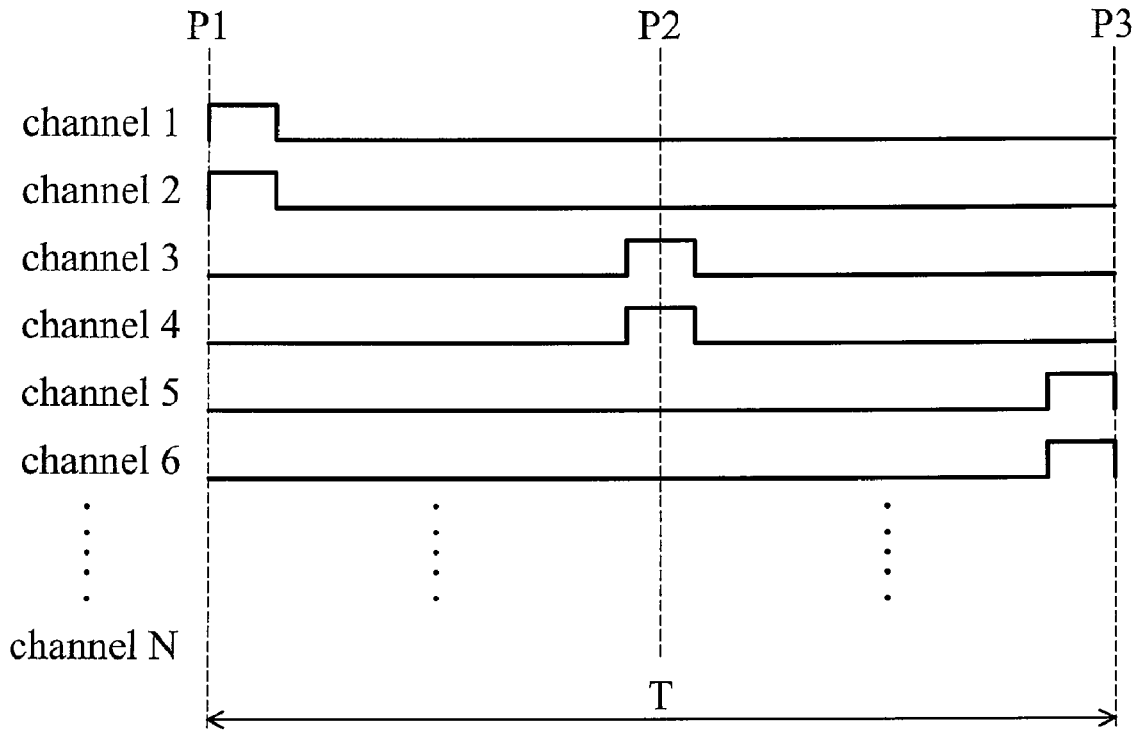
FIG. 8B shows waveforms of the segment lines provided by another method for driving an OLED panel according to an embodiment of the invention.

FIG. 8B shows waveforms of the segment lines provided by another method for driving an OLED panel according to an embodiment of the invention. Compared with FIG. 8A, each sub-group corresponds to two channel. Therefore, a first group comprises the channels 1-6. A second group comprises the channels 7-12 (not shown) and so on. Moreover, in the first group, the channels 1-6 are separately divided into a first sub-group, a second sub-group and a third sub-group. The first sub-group comprises the channels 1 and 2; the second sub-group comprises the channels 3 and 4; and the third sub-group comprises the channels 5 and 6. In this embodiment, the first PWM manner illustrated in FIG. 4 is applied to the first sub-group; the third PWM manner illustrated in FIG. 4 is applied to the second sub-group; and the second PWM manner illustrated in FIG. 4 is applied to the third sub-group. As described above, the organic light emitting diodes coupled to the same common lines can divide into a plurality of groups according to arrangement of the segment lines, and the groups can divide into a plurality of sub-groups, wherein each sub-group corresponds to different PWM manner. Furthermore, each PWM manner provides driving currents to the organic light emitting diodes of the sub-group, and each PWM manner forms waveforms increased in pulse width by measurement from different time point of the period T.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A method for driving an organic light emitting display (OLED) panel having a plurality of organic light emitting diodes, wherein the organic light emitting diodes are coupled to a plurality of segment lines and a plurality of common lines in a matrix structure, and the method comprises:

dividing the organic light emitting diodes coupled to the same common lines into a plurality of groups according to colors of the OLED panel; and providing driving currents to the organic light emitting diodes of the groups according to a plurality of pulse width modulation (PWM) manners, each corresponding to different colors of the OLED panel, wherein the PWM manners generate waveforms having pulse width corresponding to grayscale in a period, and the PWM manners comprise:

a first PWM manner forming waveforms increased in pulse width by measurement from a starting time of the period;

a second PWM manner forming waveforms increased in pulse width by measurement from an ending time of the period; and a third PWM manner forming waveforms increased in pulse width by measurement between the starting time and the ending time of the period.

2. The method as claimed in claim 1, wherein the organic light emitting diodes coupled to the same common lines are divided into a first group, a second group and a third group according to red, green and blue colors of the OLED panel.

3. The method as claimed in claim 1, wherein the third PWM manner forms waveforms increased in pulse width by measurement from a center time of the period and extending toward both sides.

4. The method as claimed in claim 1, wherein the organic light emitting diodes coupled to the same common lines are divided into a first group, a second group, a third group and a fourth group according to red, green, blue and white colors of the OLED panel.

5. The method as claimed in claim 4, wherein the PWM manners further comprises a fourth PWM manner, wherein the third PWM manner forms waveforms increased in pulse width by measurement from a first time of the period and extending toward both sides, and the fourth PWM manner forms waveforms increased in pulse width by measurement from a second time of the period and extending toward both sides, and the second time is between the first time and the ending time of the period.

6. The method as claimed in claim 1, wherein the waveforms representing the same grayscale of the first, second and third PWM manners rise at different time points in the period except for a highest grayscale.

7. The method as claimed in claim 1, wherein rising time points of the waveforms corresponding to the second and third PWM manners are separately different with the first manner except for a highest grayscale.

8. The method as claimed in claim 1, wherein the waveforms representing the same grayscale of the first, second and third PWM manners fall at different time points in the period except for a highest grayscale.

9. The method as claimed in claim 1, wherein falling time points of the waveforms corresponding to the first and third PWM manners are separately different with the second manner except for a highest grayscale.

10. A method for driving an organic light emitting display (OLED) panel having a plurality of organic light emitting diodes, wherein the organic light emitting diodes are coupled to a plurality of segment lines and a plurality of common lines in a matrix structure, and the method comprises:

dividing the organic light emitting diodes coupled to the same common lines into a plurality of groups according to arrangement of the segment lines;

dividing the group into a plurality of sub-groups; and providing driving currents to the organic light emitting diodes of the groups according to a plurality of pulse width modulation (PWM) manners, each corresponding to different sub-group, wherein the PWM manners generate waveforms having pulse width corresponding to grayscale in a period, and the PWM manners comprise:

a first PWM manner forming waveforms increased in pulse width by measurement from a starting time of the period;

a second PWM manner forming waveforms increased in pulse width by measurement from an ending time of the period; and a third PWM manner forming waveforms increased in pulse width by measurement between the starting time and the ending time of the period.

11. The method as claimed in claim 10, wherein the organic light emitting diodes coupled to the same common lines are divided into a first sub-group, a second sub-group and a third sub-group according to a specific sequence of the segment lines in the group.

12. The method as claimed in claim 10, wherein the third PWM manner forms waveforms increased in pulse width by measurement from a center time of the period and extending toward both sides.

13. The method as claimed in claim 10, wherein the waveforms representing the same grayscale of the first, second and third PWM manners rise at different time points in the period except for a highest grayscale.

14. The method as claimed in claim 10, wherein rising time points of the waveforms corresponding to the second and third PWM manners are different with the first manner, respectively.

15. The method as claimed in claim 10, wherein the waveforms representing the same grayscale of the first, second and third PWM manners fall at different time points in the period except for a highest grayscale.

16. The method as claimed in claim 10, wherein falling time points of the waveforms corresponding to the first and third PWM manners are different with the second manner, respectively.

17. An organic light emitting display (OLED), comprising:

a plurality of segment lines;

a plurality of common lines;

a plurality of organic light emitting diodes, electrically connected to the segment lines and the common lines in a matrix structure, wherein the organic light emitting diodes of one common line are divided into a plurality of groups according to colors of the OLED panel; and a segment driver coupled to the segment lines, for providing driving currents to the organic light emitting diodes of the groups according to a plurality of pulse width modulation (PWM) manners, each corresponding to different colors of the OLED panel, wherein the PWM manners generate waveforms having pulse width corresponding to grayscale in a period, and the waveforms representing the same grayscale of the PWM manners rise at different time points in the period except for a highest grayscale.

18. The OLED as claimed in claim 17, wherein the organic light emitting diodes coupled to the common line are divided into a first group, a second group and a third group according to red, green and blue colors of the OLED panel.

19. The OLED as claimed in claim 17, wherein the waveforms representing the same grayscale of the PWM manners fall at different time points in the period except for a highest grayscale.

20. The OLED as claimed in claim 17, wherein the PWM manners comprise:

a first PWM manner forming waveforms increased in pulse width by measurement from a starting time of the period;

a second PWM manner forming waveforms increased in pulse width by measurement from an ending time of the period; and a third PWM manner forming waveforms increased in pulse width by measurement between the starting time and the ending time of the period.

21. The OLED as claimed in claim 20, wherein the third PWM manner forms waveforms increased in pulse width by measurement from a center time of the period and extending toward both sides.

22. The OLED as claimed in claim 20, wherein rising time points of the waveforms corresponding to the second and third PWM manners are different with the first manner, respectively.

23. The OLED as claimed in claim 20, wherein falling time points of the waveforms corresponding to the first and third PWM manners are different with the second manner, respectively.

* * * * *